US005273057A

United States Patent [19]

Belvederi et al.

[11] Patent Number: 5,273,057

[45] Date of Patent: Dec. 28, 1993

[54] CIGARETTE MANUFACTURING MACHINE

[75] Inventors: Bruno Belvederi, S. Martino Di Monte S. Pietro; Fiorenzo Draghetti, Medicina, both of Italy

[73] Assignee: G. D Societa' Per Azioni, Italy

[21] Appl. No.: 5,239

[22] Filed: Jan. 15, 1993

[30] Foreign Application Priority Data

Jan. 15, 1992 [IT] Italy ..... 000015 A/92

[51] Int. Cl.[5] ..... A24C 5/14; A24B 7/14

[52] U.S. Cl. ..... 131/109.1; 131/108

[58] Field of Search ..... 131/108, 109.1, 109.3

[56] References Cited

U.S. PATENT DOCUMENTS

| | | | |
|---|---|---|---|
| 4,185,644 | 1/1980 | Heitmann et al. | 131/109.1 |
| 4,373,538 | 2/1983 | Steiniger | 131/109.1 |
| 4,484,589 | 11/1984 | Steiniger et al. | 131/109.1 |
| 4,681,124 | 7/1987 | Hinzmann et al. | 131/109.1 |

FOREIGN PATENT DOCUMENTS

| | | | |
|---|---|---|---|
| 1074034 | 6/1967 | United Kingdom . | |
| 2212706 | 8/1989 | United Kingdom | 131/109.1 |

*Primary Examiner*—Vincent Millin
*Assistant Examiner*—Jennifer L. Doyle
*Attorney, Agent, or Firm*—Marshall, O'Toole, Gerstein, Murray & Borun

[57] ABSTRACT

A cigarette manufacturing machine wherein a shredded tobacco distributor presents a drop-down duct for the tobacco, and a pair of rollers rotating about respective axes, for withdrawing the tobacco from the outlet of the duct. The rollers are supported on a movable frame connected to a guide device so as to move in a direction parallel to the axes of the rollers, and connected to an activating device so as to oscillate in that parallel direction and in relation to the duct.

5 Claims, 2 Drawing Sheets

CIGARETTE MANUFACTURING MACHINE

BACKGROUND OF THE INVENTION

The present invention relates to a cigarette manufacturing machine.

Cigarette manufacturing machines are known to feature a distributor for receiving shredded tobacco from a feed device and feeding it, through a carding unit and drop-down duct, to a withdrawal unit by which the shredded tobacco is withdrawn from the bottom end of the drop-down duct and fed, in the form of a relatively thin layer, on to a conveyor belt. The layer of tobacco on the conveyor belt is then fed to the bottom end of an upfeed duct along which the tobacco particles are normally drawn up by suction and deposited on to the underside of one or more suction type conveyor belts forming part of a unit for producing a continuous cigarette rod.

The main requisite of cigarette manufacturing machine is that the continuous cigarette rod be as homogeneous as possible, which in turn normally depends On the uniformity of the tobacco layer formed on the conveyor belt, and, consequently, on the regularity with which the tobacco is withdrawn from the bottom end of the drop-down duct, and the manner in which it is fed along the duct.

On known cigarette manufacturing machines, the drop-down duct normally presents a substantially rectangular section, with the long side extending perpendicular to the traveling direction of the conveyor belt. In particular, the drop-down duct presents at least one portion with a constant section, and at least one intermediate portion the section of which varies lengthwise along the duct.

Tests have shown such a design to present several drawbacks, by virtue of the tobacco fed into the duct remaining substantially unmixed and, more specifically, undergoing no change in density between the inlet of the duct and the outlet of the withdrawal unit, so that any lack of uniformity in the original mass of tobacco is reflected in the tobacco layer formed on the conveyor belt. Moreover, by virtue of the geometry of the drop-down duct, the density of the tobacco supplied tends to vary not only from one section to another, but also within each section.

SUMMARY OF THE INVENTION

It is an object of the present invention to provide a cigarette manufacturing machine having a distributor whereby the layer of tobacco formed on the conveyor belt is as homogeneous as possible.

According to the present invention, there is provided a cigarette manufacturing machine comprising a shredded tobacco distributor; said distributor in turn comprising a drop-down duct for said tobacco; means for feeding said tobacco to the inlet of said duct; and means for withdrawing said tobacco from the outlet of said duct; said withdrawal means comprising a pair of withdrawal rollers, each rotating about a respective axis; characterized by the fact that said distributor also comprises movable means for supporting said pair of rollers; and activating means, connected to said supporting means, for moving said pair of rollers reciprocatingly in relation to said duct.

The distributor preferably also comprises guide means, connected to said supporting means, for guiding the supporting means in a direction substantially parallel to the roller axes; and said activating means provide for moving said supporting means reciprocatingly in said direction.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
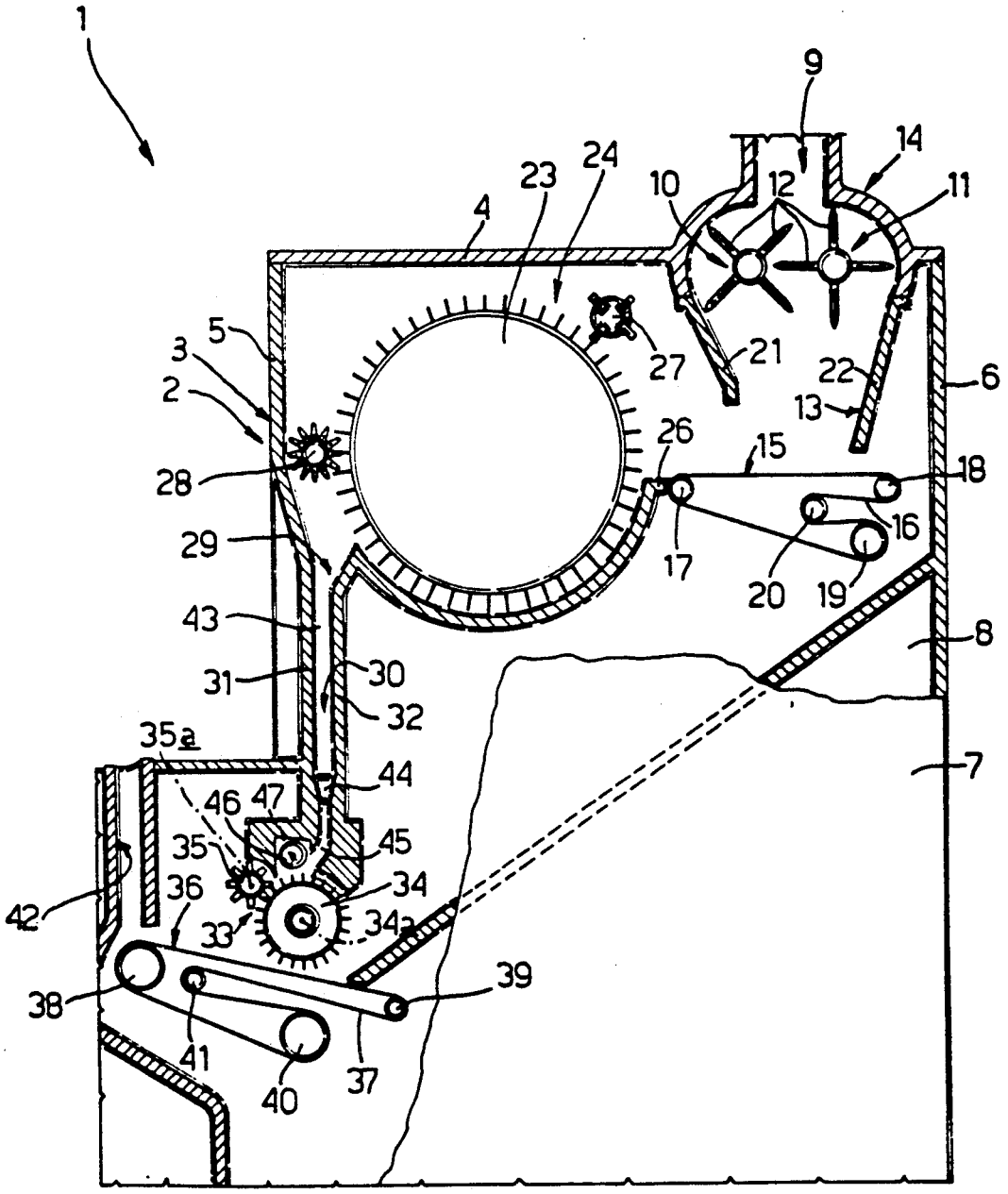
FIG. 1 shows a schematic section of a preferred embodiment of part of the cigarette manufacturing machine according to the present invention.

Number 1 in FIG. 1 indicates a cigarette manufacturing machine comprising a distributor 2 for forming a continuous, uniform stream of tobacco particles from a mass (not shown) of shredded tobacco.

Distributor 2 is housed inside a vertical casing 3 closed at the top by a horizontal wall 4, and laterally by two first vertical walls 5 and 6 and two second walls 7 and 8 substantially parallel to the FIG. 1 plane.

Top wall 4 presents an opening for the passage of a rectangular-section input duct 9, at the bottom of which two powered rotary rollers 10 and 11, each having a number of outer peripheral radial teeth 12, are housed inside casing 3.

Rollers 10 and 11 rotate in opposite directions, and provide for pre-carding and feeding the tobacco into a chamber 13 underneath.

Together with rollers 10 and 11, duct 9 defines a pre-feed unit 14 over chamber 13, the bottom of which chamber 13 is defined by a conveyor belt 15 consisting of the top branch of a belt 16 looped about three guide rollers 17, 18 and 19, and about a tensioning roller 20.

The falling tobacco is directed on to conveyor belt 15 by two walls 21 and 22 converging in the direction of conveyor 15.

On the wall 21 side, chamber 13 is defined by a toothed carding roller 23 forming part of a carding or main feed unit 24, and located adjacent to the output end of conveyor 15.

Beneath and coaxial with roller 23, provision is made for a cylindrical cowling, one end of which supports a scraper element 26 extending between roller 23 and the output end of conveyor 15.

In addition to roller 23, unit 24 also comprises a so-called metering roller 27 rotating in the same direction as and substantially tangent to roller 23, and located between roller 23 and wall 4.

By virtue of the above arrangement, the tobacco fed by pre-feed unit 14 on to conveyor 15 underneath is fed by conveyor 15 through scraper element 26 and on to carding roller 23.

Outside chamber 13 and downstream from the point of tangency of carding roller 23 and metering roller 27, carding roller 23 transfers a layer of tobacco substantially equal in thickness to the radial size of its teeth.

The layer of tobacco on roller 23 is picked off by a toothed so-called hurling roller 28 by which it is hurled, in the form of separate particles, into a feedbox 29 communicating with the inlet of a substantially vertical duct 30 defined by two walls 31 and 32. At the bottom end, duct 30 presents an outlet facing a withdrawal unit 33 comprising a movable conveyor element facing said outlet and consisting of a toothed roller 34 for withdrawing the tobacco from duct 30 and rotating about an axis 34*a* parallel to the axis of Carding roller 23.

Unit 33 also comprises a toothed hurling roller 35 by which the tobacco is picked off the teeth of roller 34 and hurled, in the form of separate particles, into a chamber having a bottom wall defined by an inclined, upward-moving collecting belt 36 traveling at a speed in the opposite direction to the surface speed of the point of roller 34 facing belt 36.

Belt 36 consists of the top branch of a belt 37 looped about three guide rollers 38, 39, 40 (at least one of which is powered) and maintained taut by tensioning roller 41.

Roller 38 is located adjacent to the bottom end of an upfeed duct 42, the top end (not shown) of which communicates with a continuous cigarette rod forming unit (not shown) wherein, as is known, the tobacco particles adhere to and form a continuous layer of tobacco (not shown) on the underside of at least one suction conveyor belt (not shown).

Still with reference to FIG. 1, duct 30 presents a substantially rectangular section, and comprises an upper input portion 43 connected to the output of feedbox 29; a downward-tapering intermediate portion 44; and an output portion 45.

The end portion of output portion 45 is defined by a feed roller 46 mounted for rotation about axis 47 and substantially tangent to roller 34.

Figure 2:
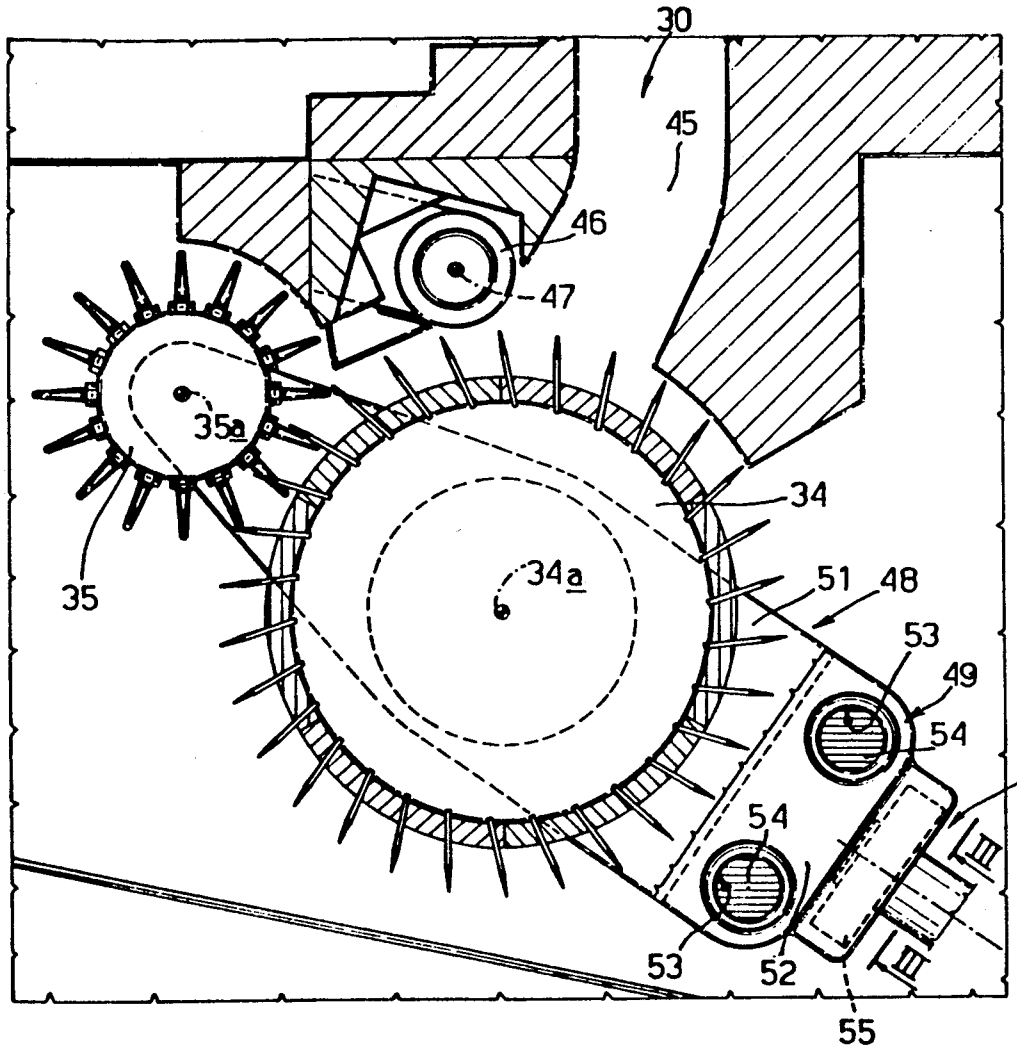
FIG. 2 shows a larger-scale section of a detail in FIG. 1.

As shown in FIG. 2, rollers 34 and 35 are supported for rotation about respective axes 34*a* and 35*a* by a movable frame 48 connected to a guide device 49 and to an activating device 50, so as to move reciprocatingly in relation to casing 3 and duct 30, and in a direction parallel to axes 34*a* and 35*a*.

Frame 48 (FIG. 2) comprises two parallel lateral brackets 51 (only one of which is shown) extending on either side of rollers 34, 35 and perpendicular to axes 34*a*, 35*a*, and connected to each other by a crosspiece 52 extending parallel to roller 35 and located on the opposite side of roller 34 as compared with roller 35.

Crosspiece 52 defines a slide for guide device 49, and presents a pair of adjacent holes 53, each formed parallel to axes 34*a* and 35*a*, and each engaged in axially-sliding manner by a respective rod 54 also parallel to axes 34*a* and 35*a* and constituting, together with the other rod 54, a guide for device 49.

Figure 3:
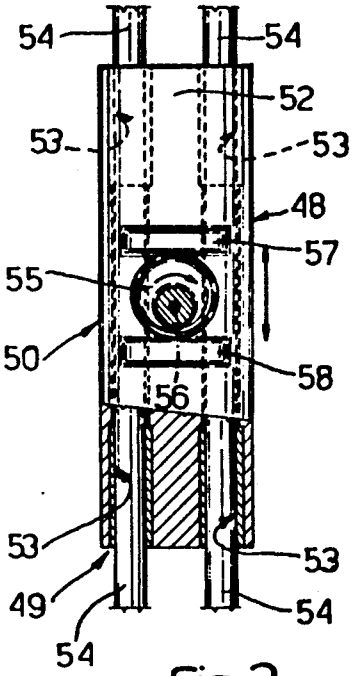
FIG. 3 shows a smaller-scale section along line III—III in FIG. 2.

As shown in FIG. 3, activating device 50 comprises a cam defined by an eccentric roller 55 rotating about an axis 56 perpendicular to axes 34*a*, 35*a* and rods 54, and by two tappet plates 57 and 58 extending parallel to brackets 51, on either side of and tangent to eccentric roller 55, and connected integral with an intermediate portion of crosspiece 52 on the opposite side of crosspiece 52 in relation to roller 34.

We claim:

1. A cigarette manufacturing machine (1) comprising a shredded tobacco distributor (2); said distributor (2) in turn comprising a drop-down duct (30) for said tobacco; means (24) for feeding said tobacco to the inlet of said duct (30); and means (34, 35, 46) for withdrawing said tobacco from the outlet of said duct (30); said withdrawal means comprising a pair of withdrawal rollers (34, 35), each rotating about a respective axis (34*a*, 35*a*); characterized by the fact that said distributor (2) also comprises movable means (48) for supporting said pair of rollers (34, 35); and activating means (50), connected to said supporting means (48), for moving said pair of rollers (34, 35) reciprocatingly in relation to said duct (30).

2. A machine as claimed in claim 1, characterized by the fact that said distributor (2) also comprises guide means (49) connected to and for guiding said supporting means (48) in a direction substantially parallel to the axes (34*a*, 35*a*) of said rollers (34, 35); said activating means (50) being designed to move said supporting means (48) reciprocatingly in said direction.

3. A machine as claimed in claim 1, characterized by the fact that said supporting means (48) Comprise a pair of brackets (51) extending on either side of and supporting said rollers (34, 35) for rotation about said respective axes (34*a*, 35*a*); and at least a crosspiece (52) connecting said brackets (51) and located adjacent to one (34) of said rollers (34, 35).

4. A machine as claimed in claim 3, characterized by the fact that said guide device (49) comprises a slide (52) integral with said supporting means (48); and a guide (54) extending parallel to the axes (34*a*, 35*a*) of said rollers (34, 35); said slide being defined by said crosspiece (52), which presents a pair of holes (53) parallel to said axes (34*a*, 35*a*); and said guide being defined by a pair of rods (54), each engaging a respective said hole (53) in axially-sliding manner.

5. A machine as claimed in claim 3, characterized by the fact that said activating means (50) comprise a cam (55) rotating about an axis (56) perpendicular to the axes (34*a*, 35*a*) of said rollers (34, 35); and two tappet plates (57, 58) extending perpendicular to said axes (34*a*, 35*a*) and on either side of and tangent to said cam (55), and connected integral with an intermediate portion of said crosspiece (52); said cam being defined by an eccentric roller (55) rotating about said axis (56) perpendicular to the axes (34*a*, 35*a*) of said rollers (34, 35).

* * * * *

UNITED STATES PATENT AND TRADEMARK OFFICE

CERTIFICATE OF CORRECTION

PATENT NO. : 5,273,057

DATED : December 28, 1993

INVENTOR(S) : Bruno Belvederi and Fiorenzo Draghetti

It is certified that error appears in the above-identified patent and that said Letters Patent is hereby corrected as shown below:

On the title page, item [30]:
Under the heading "Foreign Application Priority Data", please delete "000015 A/92" and substitute therefor --B092A 000015--.

Signed and Sealed this

Ninth Day of August, 1994

*Attest:*

Bruce Lehman

BRUCE LEHMAN

*Attesting Officer*

*Commissioner of Patents and Trademarks*